United States Patent [19]

Shinozaki et al.

[11] 4,329,139

[45] May 11, 1982

[54] COMBUSTION APPARATUS

[75] Inventors: Tadashi Shinozaki, Tsuchiura; Takashi Hashimoto, Ibaraki; Shigeyuki Yamazaki, Abiko, all of Japan

[73] Assignee: Hitachi, Ltd., Tokyo, Japan

[21] Appl. No.: 70,504

[22] Filed: Aug. 28, 1979

[30] Foreign Application Priority Data

Aug. 28, 1978 [JP] Japan ..... 53-116679[U]
Oct. 27, 1978 [JP] Japan ..... 53-131656
Apr. 12, 1979 [JP] Japan ..... 54-43074

[51] Int. Cl.[3] ..... F23D 13/24; F24H 3/06

[52] U.S. Cl. ..... 431/350; 431/354; 126/116 R

[58] Field of Search ..... 431/160, 286, 328, 349, 431/350, 351, 353, 354; 126/110 C, 110 R, 99 D, 116 R, 116 B; 239/432, 568

[56] References Cited

U.S. PATENT DOCUMENTS 2,652,107 9/1953 Hughes ..... 431/286
3,047,056 7/1962 Flynn ..... 431/349
4,006,728 2/1977 Nishi et al. ..... 126/116 R

FOREIGN PATENT DOCUMENTS 48-69345 12/1971 Japan .
52-26330 6/1977 Japan .
53-57528 5/1978 Japan .
53-67125 6/1978 Japan .
1439507 6/1976 United Kingdom ..... 431/351
2007352 5/1979 United Kingdom ..... 126/110 R

*Primary Examiner*—Samuel Scott
*Assistant Examiner*—Lee E. Barrett
*Attorney, Agent, or Firm*—Craig & Antonelli

[57] ABSTRACT

A combustion apparatus comprising a flame nozzle face of the burner being provided in a combustion chamber to face toward an opening of a throttled part provided within a burner frame, a mixed gas being injected into the combustion chamber from the flame nozzle at the flame nozzle face and at the same time a secondary air being supplied from both sides of the flame nozzle face, wherein optimum dimensional ranges of respective parts in combustion section are clarified and complete combustion is ensured thereby for any kind of fuel.

14 Claims, 10 Drawing Figures

COMBUSTION APPARATUS

BACKGROUND OF THE INVENTION

This invention relates to a combustion apparatus using a forced flue type burner, that is, a burner of such a type as to take in air necessary for combustion from outside of a room by means of a fan without discharging a flue gas to the inside of the room with a view of improving the room atmosphere or the sanitory conditions within the room, and is particularly used in a warm air generator, a drier, a boiler, etc.

More particularly, the present invention relates to a combustion apparatus provided with a slit-type flame nozzle and a throttled part in parallel to the flame nozzle in a combustion gas passage of the burner.

DESCRIPTION OF THE PRIOR ART

As a fuel for the forced flue-type burner, a fuel of poor diffusion, for example, a gasified liquid fuel such as kerosene, etc., LPG (liquid petroleum gas comprising butane and propane), etc., a fuel of low burning speed such as natural gas, etc., and a fuel of high burning speed such as a city gas, etc. are available. However, in the case of the fuel of poor diffusion, a red flame phenomenon is liable to appear, whereas in the case of the fuel of low burning speed, a phenomenon of combustion flame lift is liable to appear. In the case of the fuel of high burning speed, a flash-back phenomenon is liable to appear. Owing to these different characteristics of fuel, combustion apparatuses of different structures have been so far fabricated to meet each kind of fuel to be used. Therefore, the structures of combustion apparatuses are considerably different owing to the kind of fuel to be handled, particularly a difference between a liquid fuel and a gas fuel, and as a result, a production is disadvantageously complicated.

SUMMARY OF THE INVENTION

An object of the present invention is to provide a combustion apparatus capable of being fabricated in the same shape for every fuel, thereby increasing the effectiveness of the production line.

Another object of the present invention is to provide a combustion apparatus capable of conducting a complete combustion of any kind of fuel by clarifying optimum dimensional ranges of respective parts of a combustion section.

To attain said objects, the present invention provides a combustion apparatus comprising a burner frame, a line-form burner having a mixing chamber and a flame nozzle face, a throttled part provided within the burner frame, and a combustion chamber formed by the throttled part and the burner frame, the flame nozzle face of the burner being provided in the combustion chamber to face toward an opening of the throttled part, a mixed gas being injected into the combustion chamber from the flame nozzle at the flame nozzle face, and at the same time a secondary air being supplied therein from both sides of the flame nozzle face, wherein a width a of the flame nozzle at the flame nozzle face, a width b of the opening of the throttled part, a thickness t of the throttled part, and a distance h from the flame nozzle face to the throttled part satisfy the following relations:

$a \leqq b \leqq a+3$ mm $3 \text{ mm} \leqq t \leqq 15$ mm for a fuel of good diffusion $5 \text{ mm} \leqq t \leqq 20$ mm, for a fuel of poor diffusion $5 \text{ mm} \leqq h \leqq 10$ mm for a fuel of poor diffusion, or $10 \text{ mm} \leqq h \leqq 20$ mm for other fuel.

Other characteristics, objects and advantages of the present invention will be apparent from the following description, which will be made, referring to the accompanying drawings.

BRIEF DESCRIPTION OF THE DRAWINGS

FIG. 4 is a diagram illustrating optimum dimensional relations between the width of the opening of throttled part and the width of flame nozzle, FIG. 5 is a diagram illustrating an optimum dimensional range for the thickness of the throttled part, and FIG. 6 is a diagram illustrating optimum dimensional range for the distance from the flame nozzle face to the throttled part.

FIG. 7 is a view showing a first variant, FIG. 8 a view showing a second variant, and FIG. 9 a view showing a third variant.

PREFERRED EMBODIMENTS OF THE INVENTION

Figure 1:
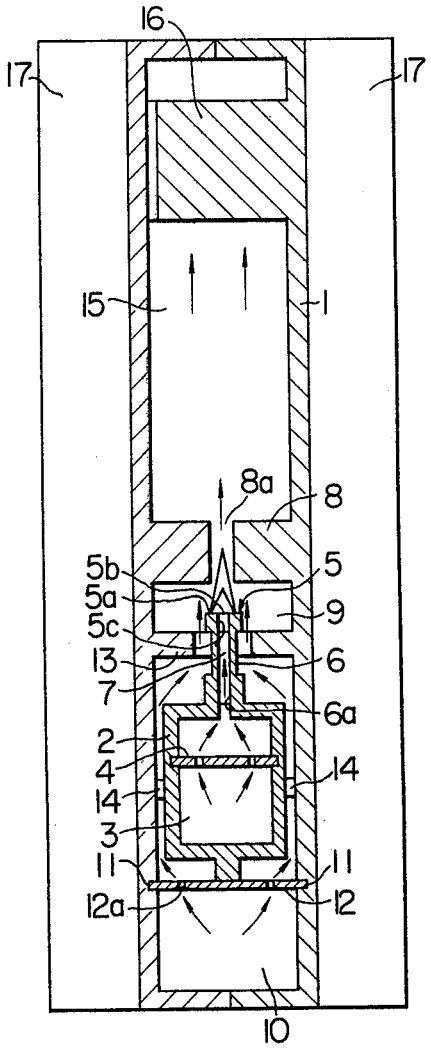
FIG. 1 is a vertical cross-sectional view showing a first mode of embodiment of the present combustion apparatus.
Figure 2:
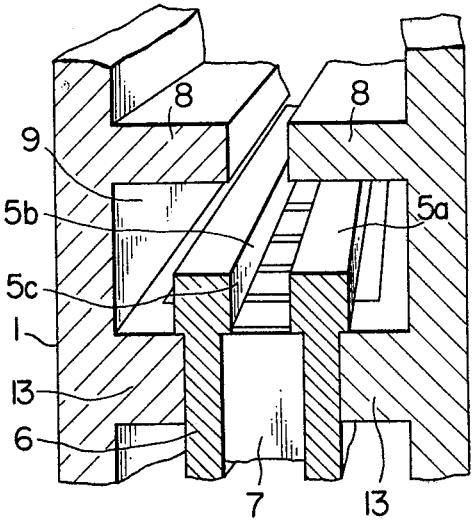
FIG. 2 is a schematic cross-sectional view showing an enlarged combustion section of the combustion apparatus shown in FIG. 1.

In FIG. 1, a cross-sectional view of a combustion apparatus according to the first mode of embodiment of the present invention is shown, and in FIG. 2 a schematic cross-sectional view of a combustion section of the combustion apparatus shown in FIG. 1 is shown on an enlarged scale.

In FIGS. 1 and 2, numeral 1 is a burner frame which is constructed to serve also as a heat exchanger, numeral 2 a burner placed with the burner frame 1, numeral 3 a mixing chamber provided within the burner 2 for mixing a fuel gas with primary air, numeral 4 a mixed gas flow-rectifying plate provided in the mixing chamber 3, numeral 5 a flame nozzle face of the burner 2 having a flat part **5*a* and a flame nozzle 5*b* at the center part of the flat part, numeral 6 a port part having a passage 6*a* for supplying the mixed gas from the mixing chamber 3 to the flame nozzle face 5, where the flame nozzle surface 5 and the port part 6** are constructed in a line form.

A corrugated-form partition plate 7 is provided in the passage **6*a* of the port part 6 a little below the flame nozzle face 5 through a space 5*c*** for dividing the mixed gas, but the partition plate 7 is not limited only to the corrugated form. When the partition plate 7 is engaged in the passage 6a of the port part 6 by sliding, a productivity of fabricating the combustion apparatus can be improved.

Numeral 8 is a throttled part provided with in the burner frame 1 and having an opening 8a at the center part of the burner frame. According to the present embodiment, the throttled part 8 is integrally constructed together with the burner frame 1.

The burner frame is constructed of a material having a good heat conductance, for example, aluminum, and thus the throttled part 8 can be effectively cooled.

A combustion chamber 9 is formed by the throttled part 8 and the burner frame 1, and the flame nozzle face 5 of the burner 2 is provided in the combustion chamber 9 to face toward the opening 8a of the throttled part 8 and to inject the mixed gas from the flame nozzle 5b at the flame nozzle face 5 into the combustion chamber 9.

Numeral 10 is a secondary air chamber to which secondary air is introduced from the outside of room by means of a fan (not shown in the drawing), numeral 11 grooves formed at both insides of the burner frame 1 below the burner 2 and numeral 12 is a support plate inserted in the grooves 11 by sliding from the side of the combustion apparatus 1 to support the burner 2 in a vertical direction, the support plate 12 being provided with a large number of perforations 12a to rectify the flow of the secondary air of the secondary air chamber 10 when the secondary air is supplied into the combustion chamber 9.

Numeral 13 is flow-rectifying plates provided at both sides of the port part 6 and supports the port part 6 against the burner frame 1 and further rectifies the flow of the secondary air already flow-rectified by the support plate 12 to supply the secondary air into the combustion chamber 9 from both sides of the flame nozzle face 5.

Numeral 14 are burner support elements supporting the burner 2 in a horizontal direction, numeral 15 a combustion gas collector chamber formed above the throttled part 8 within the burner flame 1, numeral 16 is an inside fin provided above the combustion gas collector chamber 15, and numeral 17 is outside fins provided at the outside of the burner frame 1 to conduct heat exchange with the outside air. Arrow marks in the drawing show a flow direction of a mixed gas, secondary air, or combustion gas.

Optimum dimensional ranges for respective parts in the combustion section of one embodiment as described above will be described, referring to FIGS. 3 to 6.

Figure 3:
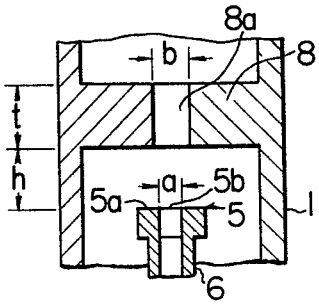
FIG. 3 is a vertical cross-sectional view of a combustion section illustrating optimum dimensional ranges of respective parts in the combustion section of the combustion apparatuses shown in FIGS. 1 and 2.

In FIG. 3, a is a width of the flame nozzle 5b at the flame nozzle face 5, b a width of the opening 8a of the throttled part 8, t a thickness of the throttled part 8, and h a distance from the flame nozzle face 5 to the throttled part 8.

$$a \leqq b \leqq a+3 \text{ mm} \quad (1)$$

At $a>b$, the throttled part 8 acts as a baffle plate, and heat is deprived by the throttled part 8, and consequently the combustion becomes incomplete and CO is liable to be generated. If b is considerably larger than a, there is substantially no throttled part 8, and the secondary air does not act effectively upon the mixed gas. That is, in a combustion apparatus handling a fuel of poor diffusion such as a gasified liquid fuel, the secondary air cannot be forcedly mixed with the mixed gas, and consequently a red flame is generated. In a combustion apparatus handling other fuel such as a city gas, natural gas, etc., it is impossible to form a sufficient recirculation flow of secondary air above the flat part 5a at the flame nozzle part 5, and consequently a flame-retaining action is decreased, and at the same time, mixing of the mixed gas with the secondary air becomes insufficient.

Figure 4:
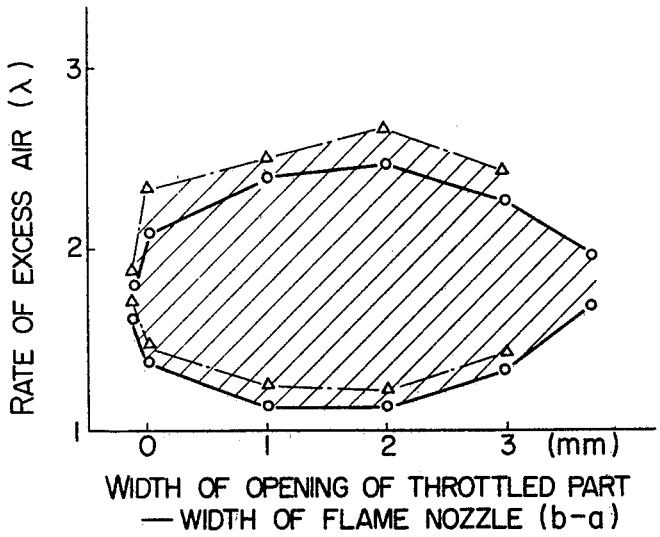
FIGS. 4–6 are diagrams showing test results where optimum dimensional ranges in the combustion section are illustrated. That is.

FIG. 4 is a diagram showing test results for illustrating the foregoing facts, wherein the abscissa shows $b-a$, and the ordinate a ratio of the actual amount of air supplied to the theoretically necessary amount of air, that is, a rate of excess air $\lambda$, and an upper limit and a lower limit of the rate of excess air $\lambda$ satisfying a condition of $CO/CO_2 \leqq 0.005$ in a combustion flue gas under a flame nozzle load (=calorific value/flame nozzle area) of 7 kcal/h/mm$^2$ are shown. Full lines show data when methane (natural gas) having a primary air content of 40% was combusted as a fuel, and alternate long and short dash lines show data when gasified kerosene having a primary air content of 80% was combusted as a fuel.

As is evident from FIG. 4, CO is liable to be generated with either fuel in the case of $b-a<0$, since the range of the rate of excess air $\lambda$ satisfying the condition of $CO/CO_2 \leqq 0.005$ is narrowed, and it is difficult to control the rate of excess air $\lambda$ to said range. In the case of $b-a>3$ mm CO is liable to be generated with methane as the fuel for the same reasons as mentioned above, and it has be confirmed in the test that red flame will be generated with the gasified kerosene as the fuel.

When a difference between the upper limit and the lower limit of the rate of excess air $\lambda$ satisfying the condition of $CO/CO_2 \leqq 0.005$ becomes small, a very high accuracy is required for the fabrication and operation of the combustion apparatus, and it is difficult to fabricate a combustion apparatus as a practical product. The size for a for effectively utilizing the secondary air is desirably below 4–5 mm.

$$3 \text{ mm} \leqq t \leqq 20 \text{ mm} \quad (2)$$

At $t<3$ mm, the action as the throttled part 8 cannot be sufficiently attained. That is, in a combustion apparatus handling a fuel of poor diffusion, it is impossible to forcedly mix the mixed gas with the secondary air, and red flame is liable to be generated. In a combustion apparatus handling other fuels, a sufficient recirculation flow by the secondary air cannot be formed. When t is considerably larger than the length of the flame, the heat of flame is deprived by the throttled part 8, and consequently the combustion becomes incomplete, and CO is liable to be generated.

Particularly in the case of a fuel having a good diffusion, the flame is relatively short, and the combustion becomes incomplete at $t>15$ mm.

Figure 5:
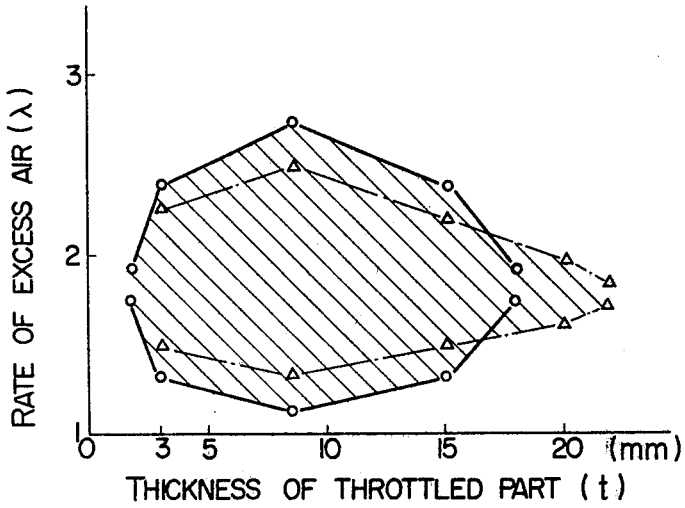

FIG. 5 is a diagram showing test results for illustrating the foregoing facts, wherein the abscissa shows a thickness t of the throttled part 8, and the ordinate and all other conditions are identical with those of FIG. 4.

As is evident from FIG. 5, CO is liable to be generated with methane as the fuel in the case of $t<3$ mm and $t>15$ mm, since the range of the rate of excess air $\lambda$ satisfying the condition of $CO/CO_2 \leqq 0.005$ is narrowed. It has been confirmed in the test that red flame will be generated with the gasified kerosene as the fuel in the case of $t<3$ mm, and CO is considerably liable to be generated in the case of $t>20$ mm, since the range of the rate of excess air λ satisfying the condition of $CO/CO_2 \leqq 0.005$ is narrowed.

$$5\ \text{mm} \leqq h \leqq 20\ \text{mm} \quad (3)$$

($5\ \text{mm} \leqq h \leqq 10$ mm for a fuel of poor diffusion and $10\ \text{mm} \leqq h \leqq 20$ mm for other fuels as a fuel to be handled).

In the case of handling a fuel of poor diffusion, the secondary air is disturbed at the flame nozzle face 5 at $h < 5$ mm, and thus a stable flame cannot be formed. At $h > 10$ mm, a sufficient mixing with the secondary air cannot be obtained in the case of a fuel of poor diffusion. By keeping h in a range of $5\ \text{mm} \leqq h \leqq 10$ mm, the forced mixing of the mixed gas with the secondary air can be attained, and at the same time a stable flame can be formed.

Even if the amount of primary air is small in the case of a fuel of good diffusion, it can be supplemented by the secondary air, and thus the amount of the secondary air to be supplied is increased. That is, at $h < 10$ mm, the secondary air is disturbed, and a stable flame cannot be formed. At $h > 20$ mm, the action of throttled part 8 is reduced, and a sufficient recirculation flow of the secondary air cannot be formed.

Figure 6:
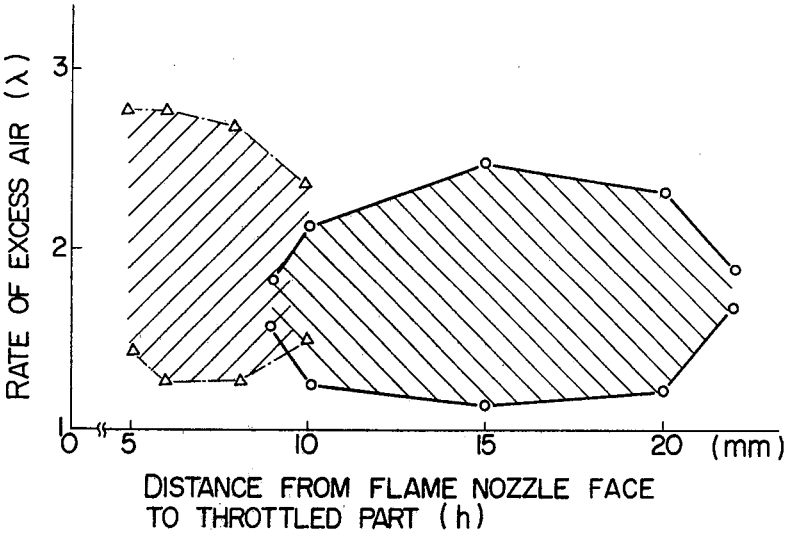

FIG. 6 is a diagram showing the test results for illustrating said facts, wherein the abscissa shows a distance h from the flame nozzle face 5 to the throttled part 8, and the ordinate and all other conditions are identical with those of FIG. 4. When gasified kerosene is used as a fuel, the secondary air is disturbed at $h < 5$ mm, and consequently a stable flame cannot be maintained. On the other hand, a $h > 10$ mm, the sufficient mixing with the secondary air cannot be obtained, and a red flame is generated.

When methane is used as a fuel, a stable flame is not formed at $h < 10$ mm, and thus CO is liable to be generated. Even at $h > 20$ mm, the mixing by recirculation flow of secondary air becomes worse, and thus CO is liable to be generated.

From the foregoing explanation (1) to (3) the optimum dimensional ranges for the respective parts in the combustion section can be summarized as follows:

$$a \leqq b \leqq a + 3\ \text{mm}$$

$$3\ \text{mm} \leqq t \leqq 15\ \text{mm}$$

$$5\ \text{mm} \leqq h \leqq 20\ \text{mm}$$

wherein $5\ \text{mm} \leqq h \leqq 10$ mm when a fuel to be handled is a fuel of poor diffusion, and $10\ \text{mm} \leqq h \leqq 20$ mm when it is other fuels.

By fabricating a combustion section of the combustion apparatus in said dimensional ranges, a complete combustion can be always obtained in the resulting combustion apparatus whenever a different kind of fuel is handled.

A function of the one embodiment of the present apparatus as described above will be explained below:

First of all, an overall function will be explained. Primary air and fuel gas are mixed together in a carburetor, etc. (not shown in the drawing), and the resulting mixed gas is led into the mixing chamber 3, where the mixed gas is further mixed, and at the same time warmed, and uniformly flow-rectified by the mixed gas flow-rectifying plate 4 and injected into the combustion chamber 9 from the flame nozzle **5*b* at the flame nozzle face 5 through the passage 6*a* of the port part 6. On the other hand, secondary air is, first of all, led into the secondary air chamber 10, uniformly flow-rectified through the perforations 12*a* of the support plate 12, passed through between the burner frame 1 and the burner 2, further flow-rectified by the flow-rectifying plate 13 while flowing along the port part 6 into the combustion chamber 9, sandwiching the mixed gas at the both sides at the flame nozzle face 5, and the secondary air is mixed with the mixed gas. The mixed gas is ignited by an ignition heat (not shown in the drawing), and a flame is formed over the flame nozzle face. The partition plate 7 provided in the passage 6*a* of the port part 6** divides the mixed gas to increase a contact area with the secondary air and promote their mixing.

There is the space **5*c* between the partition plate 7 and the flame nozzle face 5 to prevent the partition plate 7 from a temperature increase, and consequently to prevent deformation of the partition plate 7 and flash-back. A partition plate having an optimum combustion performance in shape and material can be freely used in the combustion apparatus of the present embodiment, whereas a partition plate of thermally less deformable shape and material must have been so far used. Thus, a partition plate of complicated shape can be also used to improve the mixing of the flame with the secondary air at the flame nozzle face 5**.

The throttled part 8 is integrally constructed together with the burner frame of good heat conductance, and thus can be effectively cooled. That is, formation of nitric oxides NOx from the flame passing through the throttled part can be greatly suppressed.

The function in the combustion section will be explained for each kind of fuels to be handled.

(1) When a fuel of poor diffusion such as a gasified liquid fuel, etc. is handled, a combustion apparatus must be fabricated so that a distance h from the flame nozzle face 5 to the throttled part 8 can be in such a range as $5\ \text{mm} \leqq h \leqq 10$ mm. In the thus fabricated combustion apparatus, the mixed gas injected from the flame nozzle **5*b* at the flame nozzle face 5** can be forcedly mixed with the secondary air, and thus even a fuel of poor diffusion can be sufficiently mixed with the secondary air and a complete combustion can be obtained. At the same time, the amount of primary air can be reduced. That is, a combustion apparatus capable of conducting complete combustion of even a fuel of poor diffusion such as a gasified liquid fuel, etc. can be obtained.

(2) When other fuel than that explained in (1), that is, a fuel of good diffusion such as city gas, natural gas, etc. is handled, a combustion apparatus must be fabricated so that a distance h from the flame nozzle face 5 to the throttled part 8 can be within such a range as $10\ \text{mm} \leqq h \leqq 20$ mm. In the thus fabricated combustion apparatus, a sufficient recirculation flow of secondary air can be formed over the flat part **5*a* at the flame nozzle face 5, and thus an action to maintain the flame formed over the flame nozzle face 5 can be increased, and also the mixing of the mixed gas with the secondary air can be promoted. When the action to maintain the flame is increased, a fuel of low combustion speed such as natural gas, etc. can be prevented from lifting, and also the mixing with the secondary air can be promoted. Thus, the amount of the primary air in the mixed gas can be decreased, and, in other words, the width a of the flame nozzle 5*b*** can be reduced. This has an effect upon preventing the flash-back in the case of a fuel of high burning speed such as a city gas, etc.

Even in a combustion apparatus handling any kind of fuel, dimensions other than h in the combustion section, that is, a, b and t, of course, must satisfy said conditions:

$$a \leqq b \leqq a+3 \text{ mm}$$

$$3 \text{ mm} \leqq t \leqq 15 \text{ mm}$$

As described above, the present invention provides a structure of forcedly mixing a mixed gas with the secondary air in the case of a fuel of poor diffusion, and also provides a structure of forming a sufficient recirculation flow of secondary air in the case of other fuels, thereby promoting mixing of the mixed gas with the secondary air. Thus, a combustion apparatus of same shape can be fabricated for any kind of fuels such as a fuel of poor diffusion, a fuel of low burning speed, a fuel of high burning speed, etc. That is, a production line for the combustion apparatuses handling a fuel of poor diffusion and a production line for the combustion apparatuses handling other fuels can be almost utilized in common, and thus the production lines can be more effectively utilized. Furthermore, optional dimensional ranges in the combustion section have been clarified, and thus a complete combustion can be always assured in the present combustion apparatus, irrespectively of the kind of fuel to be handled. Still furthermore, the amount of the primary air can be decreased, and consequently a capacity of a fan for supplying the primary air can be decreased. That is, the combustion apparatus can be effectively made more compact.

In the foregoing embodiment, the burner is integrally incorporated into the burner frame to make an integral structure of the entire combustion apparatus and also to make the apparatus compact, but a separate construction of the burner and the burner frame can be deemed also as another embodiment of the present invention. Furthermore, separate fabrication of a burner frame and a heat exchanger and mounting of the heat exchanger onto the burner frame without making an integrated structure of the burner frame and the heat exchanger can be also deemed as other embodiment of the present invention.

Figure 7:
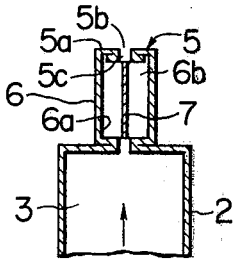
FIGS. 7–9 are vertical cross-sectional views of essential parts showing respective variants of the burner of the combustion apparatus shown in FIG. 1. That is.
Figure 8:
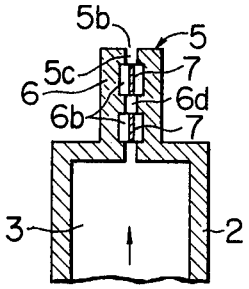
Figure 9:
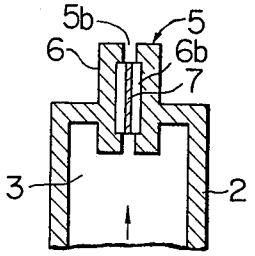

In FIGS. 7 to 9, cross-sectional views of the essential parts of variants of the burner 2 in the combustion apparatus shown in FIG. 1 are shown, where the members having reference numerals identical with those in FIGS. 1 and 2 are the same or corresponding members are those in FIGS. 1 and 2.

In FIG. 7, a first variant of the first embodiment of the present invention is shown, where the burner 2 is fabricated by press forming. The partition plate 7 is placed in a broad space *6b* in the passage *6a*. According to the present variant, the productivity to fabricate the burner 2 can be increased.

In FIG. 8, a second variant is shown, where broad spaces *6b* are provided at two stages in the passage *6a*, and the partition plates 7 are provided in the respective spaces *6b*. Such a construction assures a better flow-rectified stream of mixed gas and at the same time can reduce a pressure drop of the mixed gas because of the space *6d* being provided between the upper and lower spaces *6b*. Thus, a capacity of a fan for sending the mixed gas to the flame nozzle face 5 can be reduced. Furthermore, the burner thus constructed has a thick intermediate part at the port part 6, and thus has a high strength and a less possibility for heat deformation. Furthermore, even if the temperature of the partition plate 7 at the upper stage should be elevated, the heat can be prevented from reaching the partition plate 7 at the lower stage by providing the partition plates 7 at two stages. Thus, the flash-back to the mixing chamber 3 can be completely prevented.

In FIG. 9, a third variant is shown, where a part of the port part 6, in which the partition plate 7 is provided in the space *6b*, is extended into the mixing chamber 3. Such a structure ensures that the burner 2 can be compactly fabricated.

When the entirety of the port part 6 is formed within the mixing chamber 3 as a substitute for the third variant shown in FIG. 9, it is obvious that the burner 2 can be made more compact.

Figure 10:
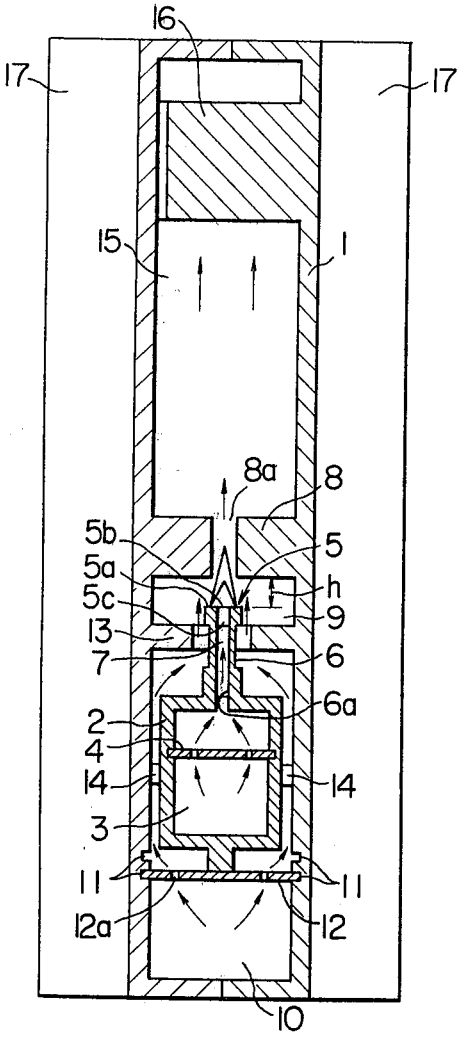
FIG. 10 is a cross-sectional view showing a second mode of embodiment of the present combustion apparatus.

In FIG. 10, a second embodiment of the present combustion apparatus is shown in a vertical cross-sectional view, where members having the reference numerals identical with those in FIG. 1 are the same members as in FIG. 1.

According to the second embodiment, grooves 11 for inserting the support plate 12 for supporting the burner 2 in a vertical direction are formed at a plurality of stages at both insides of the burner frame 1. A distance h from the flame nozzle face 5 to the throttled part 8 can be adjusted as desired by changing a position at which the support plate 12 is inserted into the grooves 11. That is, a complete combustion of every kind of fuel can be conducted in one and the same combustion apparatus by adjusting the distance h from the flame nozzle face 5 to the throttled part 8 as desired, so that h can be $5 \text{ mm} \leqq h \leqq 10 \text{ mm}$ when the fuel to be handled is a fuel of poor diffusion, and h can be $10 \text{ mm} \leqq h \leqq 20 \text{ mm}$ when the fuel to be handled is other fuels.

As described above, a distance from the flame nozzle face to the throttled part can be adjusted as desired according to the second embodiment, and thus the mixed gas can be forcedly mixed with the secondary air in the case of a fuel of poor diffusion, and a sufficient recirculation flow of the secondary air can be formed in the case of other fuels, thereby promoting the mixing of the mixed gas with the secondary air. That is, even a fuel of poor diffusion such as a gasified liquid fuel can be completely combusted, and a fuel of low combustion speed can be prevented from lifting, whereas a fuel of high burning speed can be prevented from flash back. Thus, any kind of fuels can be completely and stably combusted in one and the same combustion apparatus. In other words, a fabricator is not required for two independent production lines, that is, a production line for combustion apparatuses handling a fuel of poor diffusion on one hand, and a production line for combustion apparatuses handling other fuels on the other hand, and can utilize one common production line, thereby saving one production line. At the user's side, on the other hand, it is not necessary to change a part or the entirety of the combustion apparatus even if the kind of fuel to be handled is changed, and thus the cost can be effectively saved.

According to the second embodiment of the present invention, as described above, a means for adjusting the distance from the flame nozzle face to the throttled part comprises grooves 11 formed at a plurality of stages and a burner support plate inserted into the grooves 11, but the present invention is not always restricted to such a means. For example, an expandable port part structure can be deemed as another embodiment.

Also in the second embodiment, it is possible to modify the burner into the variants shown in FIGS. 7 to 9 in the same manner as made of the first embodiment of the present invention.

What is claimed is:

1. A combustion apparatus, which comprises a burner frame, a line-form burner having a mixing chamber for mixing a fuel with primary air and a flame nozzle having a flame nozzle face, a throttled part provided within the burner frame, and a combustion chamber formed by the throttled part and the burner frame, the flame nozzle face of the burner being provided in the combustion chamber facing toward an opening of the throttled part, the mixing chamber communicating a mixed gas with the flame nozzle for injecting it into the combustion chamber from the flame nozzle at the flame nozzle face, and supply means for directing a flow of secondary air into the combustion chamber from both sides of the flame nozzle face, wherein a width a of the flame nozzle at the flame nozzle face, a width b of the opening of the throttled part, a thickness t of the throttled part, and a distance h from the flame nozzle face to the throttled part satisfy the following relations:

$$a \leqq b \leqq a+3 \text{ mm}$$

$$3 \text{ mm} \leqq t \leqq 15 \text{ mm for a fuel of good diffusion,}$$

or $$5 \text{ mm} \leqq t \leqq 20 \text{ mm for a fuel of poor diffusion,}$$

$$5 \text{ mm} \leqq h \leqq 10 \text{ mm for a fuel of poor diffusion,}$$

or $$10 \text{ mm} \leqq h \leqq 20 \text{ mm for other fuel,}$$

wherein said flame nozzle had a passage for supplying the mixed gas to the flame nozzle face from the mixing chamber, and a partition plate means for dividing the mixed gas in a manner promoting mixing thereof with said secondary air flow is provided in the passage of the flame nozzle spaced a little below the flame nozzle face in a manner subdividing said flame nozzle into a large number of main flame nozzles for producing a large number of jet-like flames.

2. A combustion apparatus according to claim 1, wherein said flame nozzle comprises a port part having a passage for supplying the mixed gas to the flame nozzle face from the mixing chamber, a flow-rectifying plate is mounted in said burner frame for rectifying the secondary air flow and for supporting the port part and means for further flow-rectifying the secondary air flow is provided in said supply means at both sides of the port part.

3. A combustion apparatus according to claim 1, wherein the burner frame is constructed to serve as a heat exchanger at the same time.

4. A combustion apparatus according to claim 1, wherein the burner is integrally incorporated into the burner frame.

5. A combustion apparatus according to claim 3, wherein the throttled part is integrally constructed together with the burner frame.

6. A combustion apparatus according to claim 1, wherein the burner is fabricated by press forming.

7. A combustion apparatus according to claim 6, wherein said flame nozzle and mixing chamber are unitarily formed of a common press-formed structure.

8. A combustion apparatus, which comprises a burner frame, a line-form burner having a mixing chamber for mixing a fuel with primary air and a flame nozzle having a flame nozzle face, a throttled part provided within the burner frame, and a combustion chamber formed by the throttled part and the burner frame, the flame nozzle face of the burner being provided in the combustion chamber facing toward an opening of the throttled part, the mixing chamber communicating a mixed gas with the flame nozzle for injecting it into the combustion chamber from the flame nozzle at the flame nozzle face, and supply means for directing a flow of secondary air into the combustion chamber from both sides of the flame nozzle face, wherein a width a of the flame nozzle at the flame nozzle face, a width b of the opening of the throttled part, and a thickness t of the throttled part satisfy the following relations:

$$a \leqq b \leqq a+3 \text{ mm,}$$

and $$3 \text{ mm} \leqq t \leqq 15 \text{ mm}$$

and a means for adjusting a distance h from the flame nozzle face to the throttled part as desired is provided for satisfying the following relations:

$$5 \text{ mm} \leqq h \leqq 10 \text{ mm for a fuel of poor diffusion,}$$

and $$10 \text{ mm} \leqq h \leqq 20 \text{ mm for other fuel,}$$

wherein the means for adjusting a distance from the flame nozzle face to the throttled part as desired is a support plate for supporting said burner having a large number of perforations for flow-rectifying said secondary air flow, the support plate being inserted into one of a plurality of pairs of grooves provided at a plurality of distances from said throttled part at both insides of the burner frame below the burner, and the pair of grooves in which the support plate is inserted being changeable as desired for achieving said distance adjustment.

9. A combustion apparatus according to claim 8, wherein said flame nozzle comprises a port part having a passage for supplying the mixed gas to the flame nozzle face from the mixing chamber, a flow-rectifying plate is mounted in said burner frame for rectifying the secondary air flow and for supporting the port part and means for further flow-rectifying the secondary air flow is provided in said supply means at both sides of the port part.

10. A combustion apparatus according to claim 8 or 9, wherein the burner frame is constructed to serve as a heat exchanger at the same time.

11. A combustion apparatus according to claim 8 or 9, wherein the burner is integrally incorporated into the burner frame.

12. A combustion apparatus according to claim 1 or 8, wherein broad spaces are formed at two stages in the passage of the flame nozzle, and said partition plate means comprises partition plates provided in the broad spaces, respectively.

13. A combustion apparatus according to claim 1 or 8, wherein a part of the flame nozzle within which said partition plate means is located extends into the mixing chamber.

14. A combustion apparatus, which comprises a burner frame, a line-form burner having a mixing chamber for mixing a fuel with primary air and a flame nozzle having a flame nozzle face, a throttled part provided within the burner frame, and a combustion chamber formed by the throttled part and the burner frame, the flame nozzle face of the burner being provided in the combustion chamber facing toward an opening of the throttled part, the mixing chamber communicating a mixed gas with the flame nozzle for injecting it into the combustion chamber from the flame nozzle at the flame nozzle face, and supply means for directing a flow of secondary air into the combustion chamber from both sides of the flame nozzle face, wherein a width a of the flame nozzle at the flame nozzle face, a width b of the opening of the throttled part, and a thickness t of the throttled part satisfy the following relations:

$$a \leqq b \leqq a+3 \text{ mm, and}$$

$$3 \text{ mm} \leqq t \leqq 15 \text{ mm}$$

and a means for adjusting a distance h from the flame nozzle face to the throttled part as desired is provided for satisfying the following relations:

$$5 \text{ mm} \leqq h \leqq 10 \text{ mm for a fuel of poor diffusion,}$$

and $$10 \text{ mm} \leqq h \leqq 20 \text{ mm for other fuel,}$$

wherein said flame nozzle has a passage for supplying the mixed gas to the flame nozzle face from the mixing chamber, and a partition plate means for dividing the mixed gas in a manner promoting mixing thereof with said secondary air flow is provided in the passage of the flame nozzle spaced a little below the flame nozzle face in a manner subdividing said flame nozzle into a large number of main flame nozzles for producing a large number of jet-like flames.

* * * * *